United States Patent [19]

Richter

[11] Patent Number: 4,893,731

[45] Date of Patent: Jan. 16, 1990

[54] COLLAPSIBLE BAG WITH EVACUATION PASSAGEWAY AND METHOD FOR MAKING THE SAME

[75] Inventor: Simon J. Richter, Marietta, Ga.

[73] Assignee: The Coca-Cola Company, Atlanta, Ga.

[21] Appl. No.: 287,187

[22] Filed: Dec. 20, 1988

[51] Int. Cl.[4] ..... B65D 35/00

[52] U.S. Cl. ..... 222/92; 222/105; 383/906; 493/929

[58] Field of Search ..... 222/92, 95–96, 222/105, 107, 386.5, 464, 547; 383/219–220; 493/213, 929

[56] References Cited

U.S. PATENT DOCUMENTS

| | | | |
|---|---|---|---|
| 972,095 | 10/1910 | Booth | 222/92 |
| 2,339,464 | 1/1944 | Deskey | 222/92 |
| 2,891,700 | 6/1959 | Maynard | 222/92 |
| 3,838,794 | 10/1974 | Cogley et al. | 222/95 |
| 3,979,025 | 9/1976 | Friedrich et al. | 222/95 |
| 4,138,036 | 2/1979 | Bond | 222/105 |
| 4,286,636 | 9/1981 | Credle | 141/114 |
| 4,381,846 | 5/1983 | Heck | 222/105 |
| 4,524,458 | 6/1985 | Pongrass et al. | 383/33 |
| 4,601,410 | 7/1986 | Bond | 222/92 |
| 4,626,456 | 12/1986 | Farrell et al. | 428/35 |

*Primary Examiner*—Michael S. Huppert

*Attorney, Agent, or Firm*—Thomas R. Boston; W. Dexter Brooks

[57] ABSTRACT

A collapsible bag for use in containing and dispensing a liquid, such as in a bag-in-box arrangement, and a method for making the bag, wherein an elongated reinforcing strip is attached to the outside surface of one of the bag walls and extends from adjacent to the spout to remote therefrom, and a plurality of grooves are provided in the strip and also in the portion of the bag wall attached to the reinforcing strip, thus providing liquid passageways inside of the bag to achieve complete withdrawal of the liquid from the bag as the bag collapses, without the expense and complication of having to insert a separate dipstrip member into the bag and to connect it to the spout.

29 Claims, 5 Drawing Sheets

COLLAPSIBLE BAG WITH EVACUATION PASSAGEWAY AND METHOD FOR MAKING THE SAME

BACKGROUND OF THE INVENTION

The present invention relates to collapsible bags, of the type used in bag-in-box, for containing and dispensing liquids, such as post-mix, soft drink syrups, and to a method for making such bags. More particularly, this invention relates to such bags having passageways therein to achieve complete withdrawal of liquid from the bag as the bag collapses, regardless of the location of the bag spout.

Bags for bag-in-box containers are well-known (see for example, U.S. Pat. Nos. 4,601,410; 4,137,930; 4,138,036; 4,286,636; 3,171,571; and 2,859,899) and some include inserts placed inside of the bag to provide a passageway for complete withdrawal of the liquid from the bag as the bag collapses. Some of these inserts, such as dip tubes, are inserted after the bag is made and have the disadvantage of the added time and expense to carry out this separate, additional task. Others of these inserts are placed between the bag walls before the bag walls are joined to form the bag, however, these bags are subject to the disadvantages of the added time, expense and difficulty of positioning these inserts between the bag walls and also of then securing the inserts to the spout so that the passageway provided by the insert will be in liquid communication with the spout opening. In addition, some of these inserts, being adjacent or under the spout can interfere with or slow down the filling process. Another disadvantage is the possibility of these inserts become detached from the spout.

It is an object of the present invention to provide an improved bag and method for making the bag that overcomes many of these disadvantages in the prior art.

It is another object of this invention to provide such a bag with a passageway therein without the necessity of having to place an insert therein.

It is a still further object of this invention to provide a bag and method for making the bag which provides a passageway in liquid communication with the spout opening, without having to attach an insert or anything else to the spout.

It is a still further object of this invention to provide such a bag and method for making the same which bag and method are less expensive than the prior art.

It is another object of this invention to provide such a bag which can be filled easier and faster, which provides no restriction at the spout, and which has no insert that could be accidentally detached.

It is a further object of this invention to provide a method for making such a bag that can operate at a higher speed.

SUMMARY OF THE INVENTION

A collapsible bag for containing and dispensing a liquid, such as a post-mix soft drink syrup, and a method for making the bag. The bag is particularly useful in the bag-in-box system. The bag includes an elongated reinforcing strip sealed to the outside surface of one of the bag walls; the strip and the portion of the bag wall sealed thereto have a plurality of elongated grooves therein that provide liquid passageways inside of the bag in liquid communication with the spout. The grooves are of such size and shape that as the bag collapses it cannot collapse into and close the passageways, whereby the passageways permit and achieve complete withdrawal of the liquid from the bag as the bag collapses.

The method of this invention includes, in the preferred embodiment, sealing a flat reinforcing strip to the outside surface of the bag wall opposite the wall having the spout, before the bag walls are joined together to form the bag, and then pressure forming the grooves into the strip and the attached portion of the bag wall.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
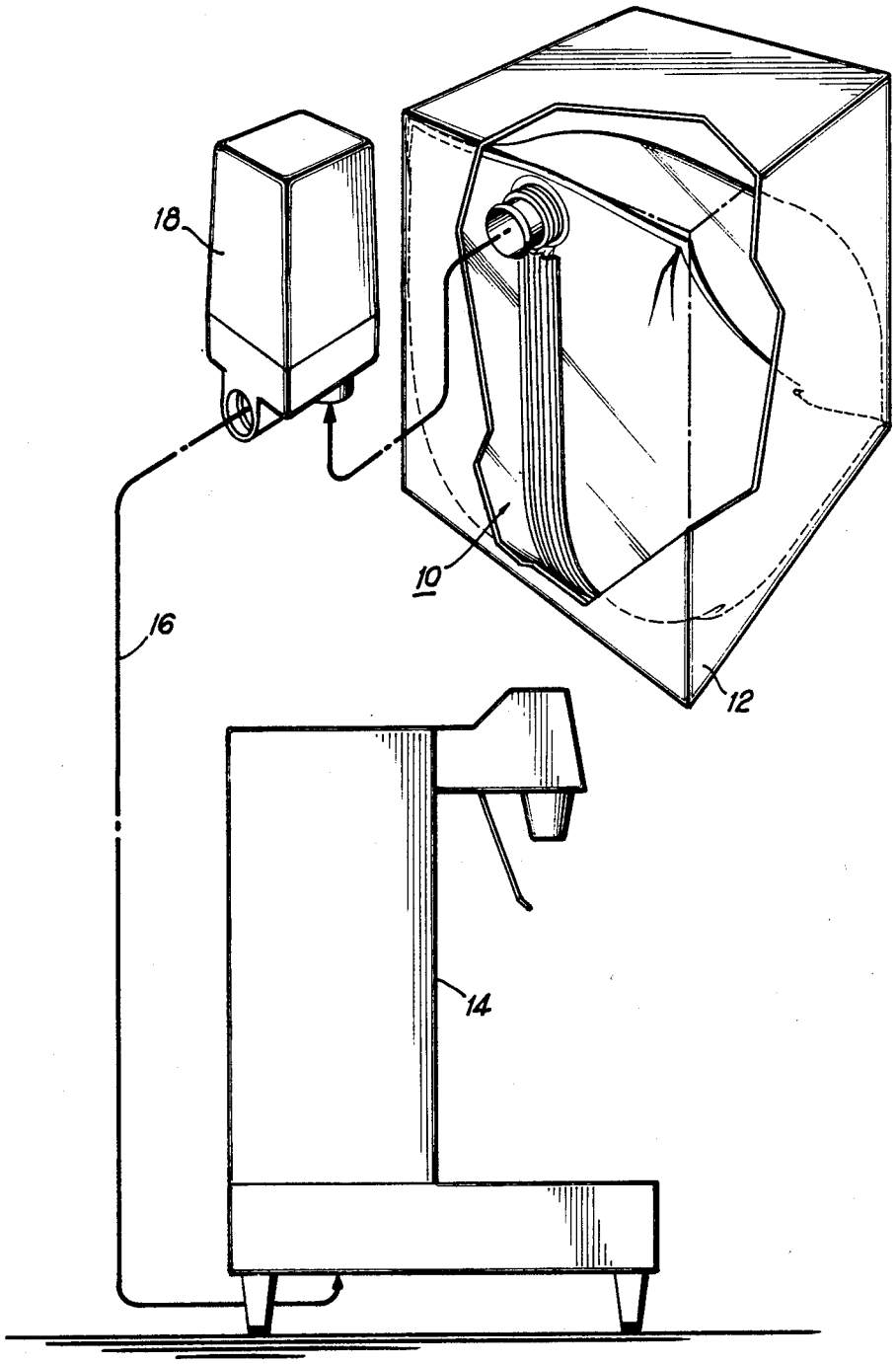
FIG. 1 is a partly diagrammatic, partly broken away perspective view of the overall arrangement in which the bag of the present invention can be used.

With reference now to the drawings, FIG. 1 shows a typical arrangement in which the bag 10 of this invention can be used. The bag 10 is contained in a paperboard box 12 and supplies liquid, such as soft drink syrup, to a post-mix dispenser 14 through a line 16 via a pump 18.

As the liquid is withdrawn, the bag 10 collapses. It is desirable to be able to put the bag in any orientation (such as with the spout 24 at the top as shown in FIG. 1) and still have all of the liquid dispensed from the bag leaving little or no liquid remnant. The reinforcing strip 26 of the present invention provides this advantage.

Figure 2:
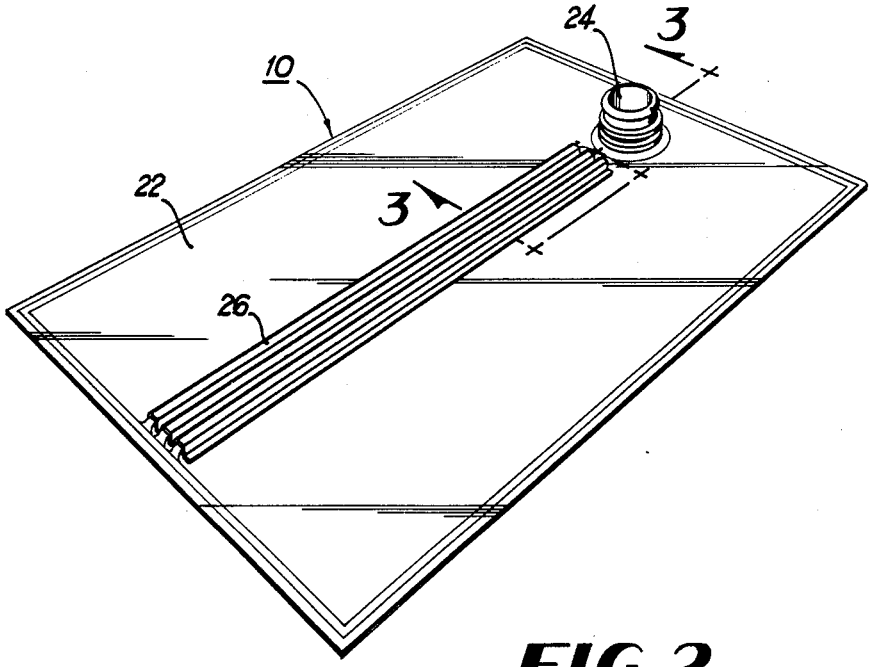
FIG. 2 is a perspective view of a bag of the present invention.
Figure 3:
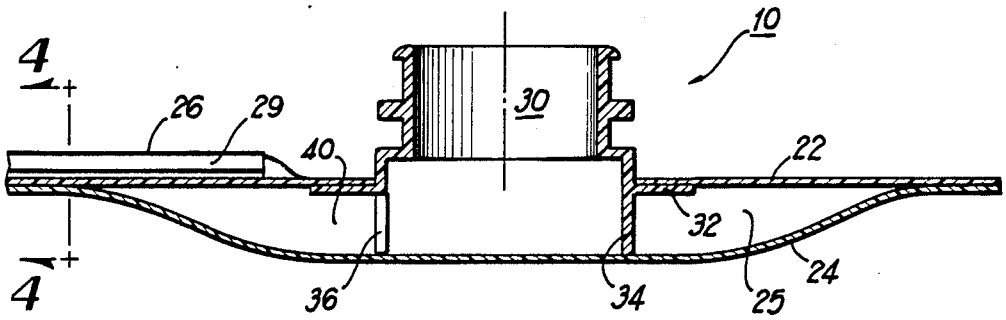
FIG. 3 is a partial cross-sectional view taken along line 3—3 of FIG. 2.
Figure 4:
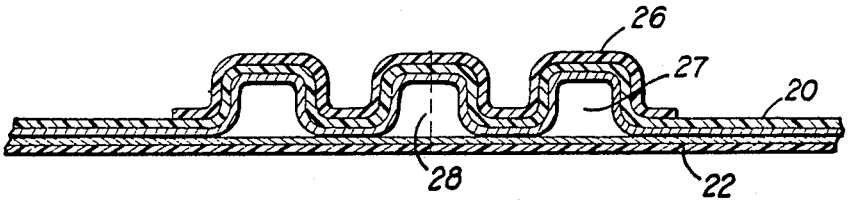
FIG. 4 is a partial cross-sectional view taken along line 4—4 of FIG. 3.

FIGS. 2–4 show the collapsible bag 10 according to one embodiment of the present invention including a pair of liquid-tight, flexible bag walls 20 and 22, joined at their peripheries, a spout 24 connected to one bag wall 20 and having a spout opening 30 therethrough in liquid communication with the inside 25 of the bag 10, and an elongated reinforcing strip 26 attached to the outside surface of the bag wall 20 and extending from adjacent to the spout 24 to remote therefrom.

The strip 26, and the portion of the bag wall to which the strip is sealed, include a plurality of straight, elongated, grooves 27. These grooves form liquid passageways 28 inside of the bag 10. The passageways 28 have a depth and a width such that as the bag wall collapse during dispensing of liquid from the bag, the bag wall cannot collapses into and block the liquid flow through the passageways 28, such that these passageways remain open and permit and achieve complete withdrawal of the liquid from the bag as the bag collapses.

Figure 5:
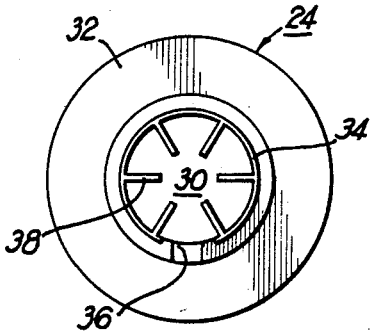
FIG. 5 is a bottom plan view of a spout according to one embodiment of this invention.
Figure 6:
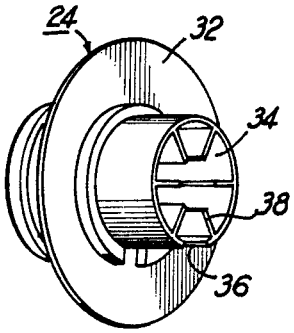
FIG. 6 is a perspective view of the spout of FIG. 5.

FIGS. 3, 5 and 6 show a spout 24 having a spout opening 30 therethrough, a spout flange 32 sealed to the bag wall 20, and a spout extension 34 extending into the bag a sufficient distance to provide an open channel 40 between the passageways 28 and the spout opening 30 even as the bag wall 22 collapses against the spout extension 34. The extension 34 preferably includes a plurality of radial ribs 38 to hold the bag wall 22 out of the opening 30. The extension 34 also includes an opening 36 which is part of the open channel 40. FIG. 3 also shows the proximal end 29 of the reinforcing strip 26 located adjacent to the spout flange 32.

FIG. 4 is a cross-sectional view through the strip 26 showing the grooves 27 and the liquid passageways 28 defined by the grooves 27. FIG. 4 shows the bag 10 after it is formed and ready for shipment and also as it looks after the liquid has been dispensed and the bag wall 22 has collapsed against the bag wall 20 leaving the open passageways 28 for allowing any remaining liquid in the bag 10 a passageway out of the collapsed bag.

Figure 7:
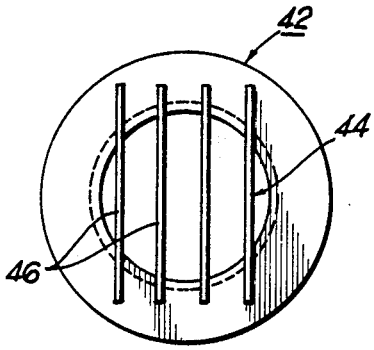
FIG. 7 is a bottom plan view of a spout according to another embodiment of this invention.
Figure 8:
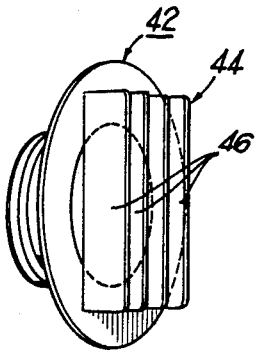
FIG. 8 is a perspective view of the spout of FIG. 7.

FIGS. 7 and 8 show a spout 42 according to another embodiment of this invention. This spout is similar to the spout 30 except for a different spout extension 44 comprising a plurality of flat, straight, parallel, spaced-apart, plates 46 that serve the same purpose as does the spout extension 34 described above.

Figure 9:
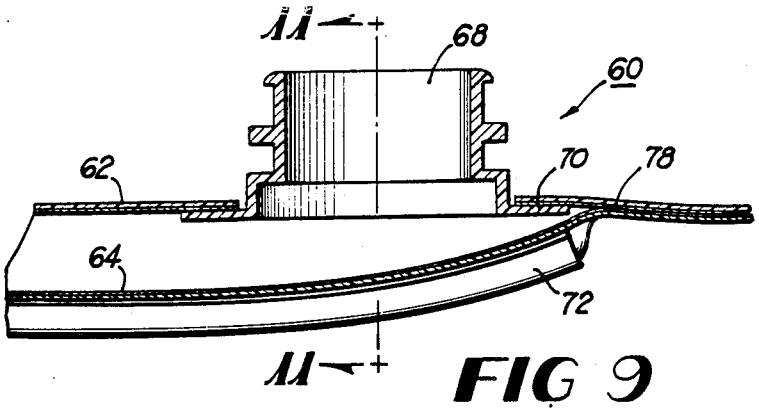
FIG. 9 is a partial cross-sectional view through a bag according to a preferred embodiment of the present invention.
Figure 10:
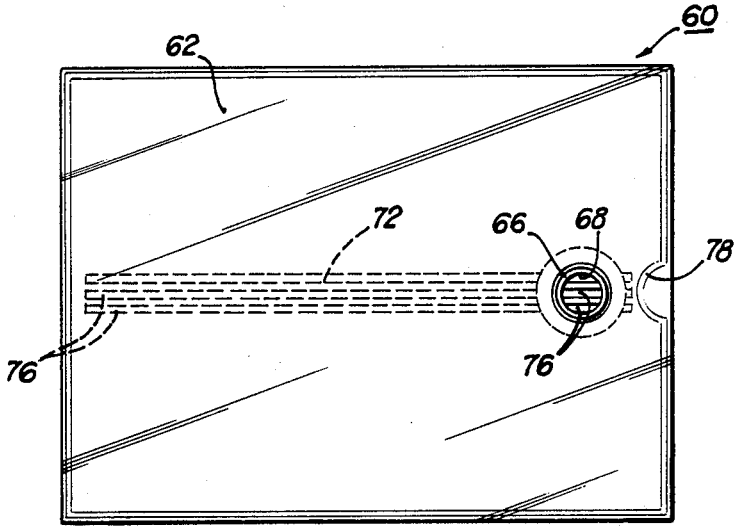
FIG. 10 is top plan view of the bag of FIG. 9.
Figure 11:
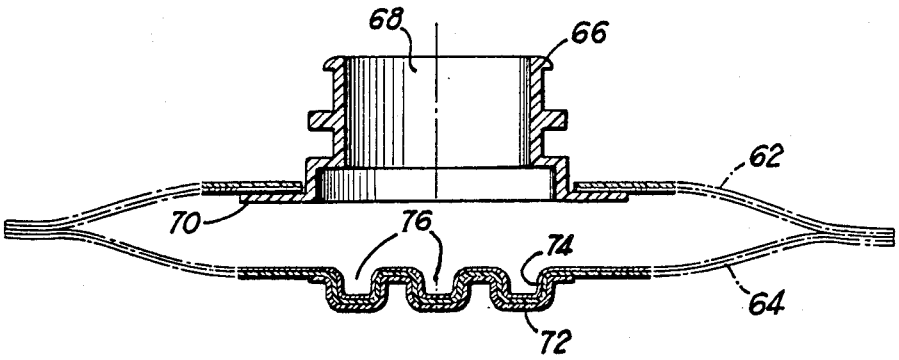
FIG. 11 is a partial cross-sectional view along line 11—11 of FIG. 10.

FIGS. 9–11 show a bag 60 according to a preferred embodiment of the present invention. The bag 60 includes a pair of bag walls 62 and 64, a spout 66 having a spout opening 68 therethrough and a flange 70 sealed to the bag wall 62. In this embodiment, the reinforcing strip 72 is sealed to the bag wall 64, that is, the bag wall opposite to the wall 62 to which the spout 66 is attached. The strip 72 includes grooves 74 formed therein and in the attached portion of the bag wall 64 to provide the liquid passageways 76.

The strip 72 is located as shown in FIGS. 9–11 from underneath the spout 66 to remote from the spout. Because it is possible for the two bag walls to twist slightly, in which case the passageways 76 might not remain directly under the spout 66, it is preferred to seal the two bag walls 62 and 64 together adjacent to the spout such as along a seal line 78, to prevent such shifting. This additional seal line 78 will assure that the passageways 76 will be in liquid communication with the spout opening 68 at all times.

Figure 12:
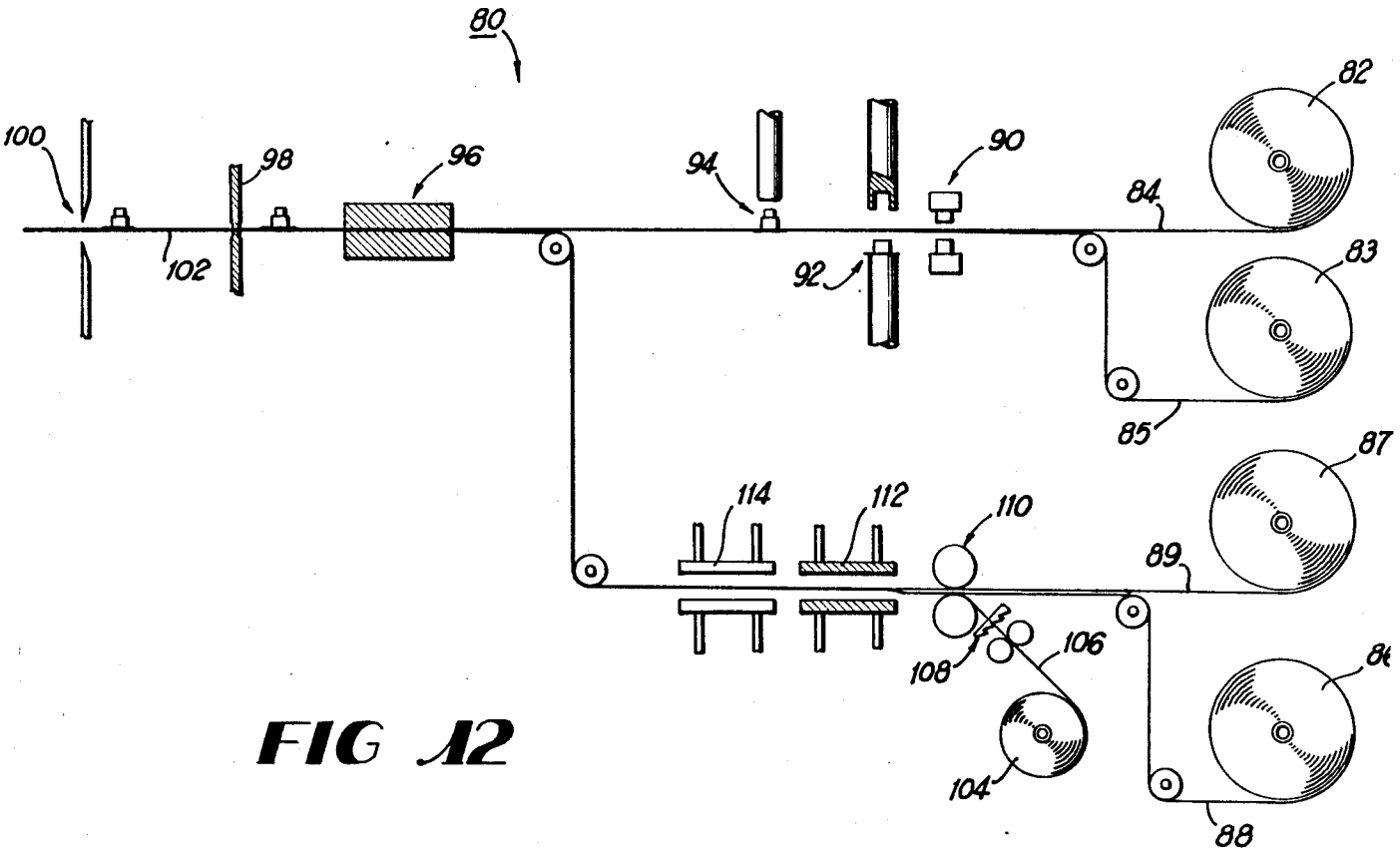
FIG. 12 is a flow diagram showing the method of the present invention.

FIG. 12 illustrates the method of making the bag 60 according to the present invention. FIG. 12 shows a manufacturing system 80 including a pair of rolls 82 and 83 supplying layers 84 and 85 of material to make bag wall 20, a pair of rolls 86 and 87 supplying layers 88 and 89 of material to make bag wall 22, a bag hole cutter 90, a spout sealer 92, a valve inserter 94, a side sealer 96 for sealing the side edges of the bag 60, an end sealer 98 for sealing the end edges of the bag 60, a perforator 100 for providing perforations between each bag 60 in the continuous web 102 of bags, a roll 104 of reinforcing strip material 106, a cutter 108, a pair of heated rolls 110 to tack the strip 72 to bag wall 64, a pair of plates 112 to seal the strip 72 to the bag wall 64 and to preheat the material prior to forming the grooves, and a pair of water cooled, pressure forming plates 114, for forming the grooves 74. A bag valve (that is inserted into the spout by the valve inserter 94 is well-known and forms no part of this invention). It usually snaps into the spout and closes the spout opening until a disconnect attached to line 16 is connected to the valve.

The reinforcing strip of this invention is preferably made of LLDPE having a thickness of 10 mil. However, other thickness and other materials can be used. It is preferably heat sealed to the wall but it could be sealed in other ways. The temperature of the groove forming plates preferably between about 300°–450° F. and they close for 1–3 seconds. However, other temperatures and times can be used, as well as other methods of forming the grooves. The bag walls and the reinforcing are preferably plastic. The flexible wall layers may comprise any desired number of layers, although two are preferred. Layers 85 and 89 are preferably a web of 2 mil. EVA disposed adjacent to the layers 84 and 88 which are preferably a bonded web made up of the following three sheets: 2 mil. EVA, ½ mil. metalized PET, and a 2 mil. EVA. The reinforcing strip is preferably 10 mil. LLDPE. The size and shape of the passageways is such as to prevent the bag wall from collapsing thereinto and closing off the passageway. The dimensions depend, for example, on the stiffness of the bag wall. For example, the passageways can have a width of about 2.5 millimeters and a depth of about 4.5 mm.

While the preferred embodiment of this invention has been described above in detail, it is to be understood that variations and modifications can be made therein without departing from the spirit and scope of the present invention. For example, while only one reinforcing strip has been shown, two or more can be used, if desired. Other shapes, widths and lengths of the strip can be used. Other shapes and numbers of grooves (and passageways) can be used. Other materials can be used. Other numbers of bag wall layers (such as 1, 3 etc.) can be used. Other ways of forming the grooves and sealing the strip to the wall can be used. The strip can have the grooves therein prior to sealing it to the bag wall. The method can use a continuously moving strip, rather than an intermittently moving strip. Other shapes of sealing lines 78 can be used. The bag is preferably formed by joining two separate rectangular bag walls together, however, other numbers of bag walls can be joined together to form the bag. The spout is preferably connected to a bag wall before the walls are joined to form the bag, however, the spout can be attached after the bag is formed, if desired.

What is claimed is:

1. A collapsible bag for use in containing and dispensing a liquid comprising:

(a) a liquid tight bag having a flexible bag wall;

(b) a spout attached to said bag wall and having a spout opening therethrough in liquid communication with the inside of said bag;

(c) an elongated reinforcing strip sealed to an outside surface of said bag wall and extending from adjacent to said spout to a position remote from said spout; and (d) said reinforcing strip including at least one elongated groove therein which also exists in the portion of said bag wall attached to said reinforcing strip, said groove providing at least one elongated liquid passageway inside of said bag in liquid communication with said spout opening, said at least one passageway having a depth and a width such that as said bag wall collapses during dispensing of liquid from the bag, the bag wall can not collapse into and block said passageway, such that said passageway remains open to achieve complete withdrawal of liquid from said bag as said bag collapses.

2. The bag as recited in claim 1 wherein said strip and said portion of said bag wall attached thereto includes a plurality of said elongated grooves providing a plurality of said passageways.

3. The bag as recited in claim 2 wherein all of said grooves have a constant cross-section throughout their entire length.

4. The bag as recited in claim 2 wherein all of said grooves run approximately the entire length of said strip.

5. The bag as recited in claim 2 wherein said spout includes an extension extending into said bag and having side openings into said spout opening such that the bag wall opposite to said spout cannot collapse into and seal off said spout opening.

6. The bag as recited in claim 5 wherein said strip is on the bag wall to which said spout is connected and wherein said extension provides an open channel from said passageway to said spout opening even when said bag wall has fully collapsed against said extension.

7. The bag as recited in claim 6 wherein said extension is a hollow cylinder having said side openings therethrough adjacent to said strip.

8. The bag as recited in claim 7 wherein said hollow cylinder includes a plurality of spaced-apart radial ribs extending inwardly therefrom to prevent said bag wall from collapsing into said hollow cylinder.

9. The bag as recited in claim 6 wherein said extension includes a plurality of flat, straight, parallel, spaced-apart plates extending perpendicular to said spout flange.

10. The bag as recited in claim 2 wherein said strip is flexible and straight.

11. The bag as recited in claim 2 wherein said bag wall includes a pair of bag walls sealed at their peripheries, said spout is sealed to one of said bag walls, and said strip is sealed to the other of said bag walls.

12. The bag as recited in claim 11 wherein said strip runs underneath said spout, such that said passageways are directly underneath said spout opening.

13. The bag as recited in claim 12 wherein said strip includes a proximal end adjacent to said spout.

14. The bag as recited in claim 13 wherein said bag walls are additionally sealed together adjacent to said spout and to said proximal end of said strip to prevent said walls from shifting and to prevent said passageways from moving out of liquid communication with said spout opening.

15. The bag as recited in claim 14 wherein said spout is located adjacent to one edge of said bag.

16. The bag as recited in claim 2 wherein said bag wall includes a pair of bag walls sealed at their peripheries, said spout is sealed to one of said bag walls, and said strip is sealed to the other one of said bag walls.

17. The bag as recited in claim 2 wherein said grooves terminate short of each end of said strip to eliminate any sharp edges.

18. The bag as recited in claim 2 wherein said strip is heat sealed to said bag wall.

19. The bag as recited in claim 18 wherein said bag wall comprises a pair of separate bag wall layers and wherein said strip and both of said layers are sealed together.

20. The bag as recited in claim 19 wherein said strip and both of said layers are heat sealed together.

21. The bag as recited in claim 20 wherein said strip is made of linear low density polyethylene.

22. A bag comprising:

(a) a liquid-tight, collapsible bag wall;

(b) a spout sealed to said bag wall;

(c) an elongated reinforcing strip sealed to the outside surface of said bag wall and having a proximal end adjacent to said spout, and said strip and the portion of said bag wall sealed thereto having a plurality of elongated grooves therein providing a plurality of elongated liquid passageways inside of said bag in liquid communication with said spout.

23. A method for making a collapsible bag for use in containing and dispensing a liquid comprising the steps of:

(a) forming a collapsible bag with a liquid-tight, flexible, bag wall;

(b) attaching a spout to said bag wall, said spout having a spout opening therethrough in liquid communication with the inside of said bag; and (c) sealing an elongated reinforcing strip to the outside surface of said bag wall and extending from adjacent to said spout to remote from said spout, providing at least one elongated groove in both said strip and in the attached portion of said bag wall, said grooves providing the inside of said bag with a liquid passageway in liquid communication with said spout opening and extending from adjacent to said spout to remote from said spout, said passageway having a size such that as said bag wall collapses during dispensing of liquid from the bag, the bag wall cannot collapse into and block said passageway, such that said passageway remains open to achieve complete withdrawal of liquid from said bag as the bag collapses.

24. The method as recited in claim 23 wherein said bag forming step comprises joining two bag walls together at their peripheries, and wherein said sealing step comprises sealing said strip to one of said two bag walls prior to joining said bag walls together to form said bag.

25. The method as recited in claim 24 wherein said sealing step comprises sealing said strip in flat form to said one of said bag walls, and wherein said groove providing step comprises pressure forming said groove simultaneously in both said strip and in said attached portion of said bag wall, subsequent to said sealing step and prior to said joining step.

26. The method as recited in claim 25 wherein said pressure forming step comprises positioning said strip and said attached portion of said bag wall between a pair of groove forming plates and pressing said plates together.

27. The method as recited in claim 24 wherein said spout attaching step comprises attaching said spout to one of said bag walls and sealing said strip to the other of said bag walls.

28. The method as recited in claim 27 including locating a proximal end of said strip directly below said spout opening.

29. The method as recited in claim 28 including the step of additionally joining said two walls together adjacent to said spout and said proximal end of said strip.

* * * * *